US010939703B2

(12) United States Patent
Li et al.

(10) Patent No.: US 10,939,703 B2
(45) Date of Patent: Mar. 9, 2021

(54) HEATING ASSEMBLY, ATOMIZER AND ELECTRONIC CIGARETTE HAVING SAME

(71) Applicant: Shenzhen First Union Technology Co., Ltd., Shenzhen (CN)

(72) Inventors: Yonghai Li, Shenzhen (CN); Zhongli Xu, Shenzhen (CN); Shuyun Hu, Shenzhen (CN)

(73) Assignee: SHENZHEN FIRST UNION TECHNOLOGY CO., LTD., Shenzhen (CN)

( * ) Notice: Subject to any disclaimer, the term of this patent is extended or adjusted under 35 U.S.C. 154(b) by 629 days.

(21) Appl. No.: 15/462,788

(22) Filed: Mar. 17, 2017

(65) Prior Publication Data

US 2017/0188636 A1 Jul. 6, 2017

(30) Foreign Application Priority Data

Mar. 21, 2016 (CN) ..... 201620219324.9

(51) Int. Cl.
*A24F 47/00* (2020.01)
*H05B 6/10* (2006.01)
*H05B 6/36* (2006.01)

(52) U.S. Cl.
CPC ..... *A24F 47/008* (2013.01); *H05B 6/108* (2013.01); *H05B 6/36* (2013.01); *H05B 6/362* (2013.01)

(58) Field of Classification Search
CPC ..... A24F 47/008; H05B 6/108; H05B 6/36; H05B 6/362
USPC ..... 219/672, 628, 635, 667, 535, 538, 539, 219/260; 392/390, 391, 386, 392, 393, 392/394, 395; 131/194, 197, 195, 196, 131/335, 273, 128, 200.14, 202.21, 131/203.26, 203.27, 330, 200, 331, 359, 131/360; 338/306, 310, 318, 319; 128/202.21, 203.27, 204.23, 204.24, 128/200.11–200.24, 203.12, 203.15, 128/203.16, 203.17, 203.26, 204.17, 128/204.18, 204.21
See application file for complete search history.

(56) References Cited

U.S. PATENT DOCUMENTS 5,190,060 A * 3/1993 Gerding ..... A24B 15/165 131/194
6,089,857 A * 7/2000 Matsuura ..... A61M 15/06 431/142

(Continued)

OTHER PUBLICATIONS

Shvets1974_Article_PermanentMagnetsFromFineIronAn.pdf (Year: 1974).*
Heating-effect-iron-cobalt-magnetic-nonofluids.pdf (Year: 2013).*

*Primary Examiner* — Dana Ross
*Assistant Examiner* — Ket D Dang
(74) *Attorney, Agent, or Firm* — Cheng-Ju Chiang

(57) ABSTRACT

An exemplary heating assembly includes a liquid conducting and heating body and an inductive coil corresponding to the liquid conducting and heating body. The liquid conducting and heating body includes a micro-porous ceramic main body and a metallic powder evenly distributed in the ceramic main body. The inductive coil is configured for generating high frequency magnetic field in response to an alternating current, so that eddy current and heat are generated in the liquid conducting and heating body. The liquid conducting and heating body is configured for absorbing tobacco liquid and heating the tobacco liquid to form aerosol.

6 Claims, 4 Drawing Sheets

(56) References Cited

U.S. PATENT DOCUMENTS

| | | | | |
|---|---|---|---|---|
| 6,155,268 | A * | 12/2000 | Takeuchi | A24F 47/008 131/273 |
| 7,300,038 | B2 * | 11/2007 | Gregg | C23C 16/4481 118/726 |
| 2007/0267031 | A1 * | 11/2007 | Hon | A61M 11/044 131/273 |
| 2013/0015178 | A1 * | 1/2013 | Lin | B29C 45/73 219/660 |
| 2014/0041658 | A1 * | 2/2014 | Goodman | F22B 1/282 128/203.14 |
| 2014/0334804 | A1 * | 11/2014 | Choi | A61M 15/06 392/404 |
| 2015/0216237 | A1 * | 8/2015 | Wensley | A24F 47/008 131/273 |
| 2015/0245669 | A1 * | 9/2015 | Cadieux | A61M 15/06 131/329 |
| 2015/0320116 | A1 * | 11/2015 | Bleloch | A61M 15/06 219/628 |
| 2015/0335071 | A1 * | 11/2015 | Brinkley | F22B 1/284 131/328 |
| 2015/0359262 | A1 * | 12/2015 | Liu | C04B 35/6263 131/329 |
| 2016/0021934 | A1 * | 1/2016 | Cadieux | A24F 47/008 131/328 |
| 2017/0238610 | A1 * | 8/2017 | Reevell | G06F 1/3203 |

* cited by examiner

HEATING ASSEMBLY, ATOMIZER AND ELECTRONIC CIGARETTE HAVING SAME

TECHNICAL FIELD

The present invention relates to a heating assembly, an atomizer and an electronic cigarette using same.

BACKGROUND ART

A typical electronic cigarette includes a liquid conducting body, and a heating wire wrapped around the liquid conducting body. The heating wire is in tight contact with the liquid conducting body. Heat of the heating wire is conveyed to the liquid conducting body, and then the tobacco liquid in the liquid conducting body is heated to form aerosol. However, a thermal efficiency of the electronic cigarette is low.

What are needed, therefore, are a heating assembly, an atomizer and an electronic cigarette using same, which can overcome the above shortcomings.

SUMMARY

An exemplary heating assembly includes a liquid conducting and heating body and an inductive coil corresponding to the liquid conducting and heating body. The liquid conducting and heating body includes a micro-porous ceramic main body and a metallic powder evenly distributed in the ceramic main body. The inductive coil is configured for generating high frequency magnetic field in response to an alternating current, so that eddy current and heat are generated in the liquid conducting and heating body. The liquid conducting and heating body is configured for absorbing tobacco liquid and heating the tobacco liquid to form aerosol.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
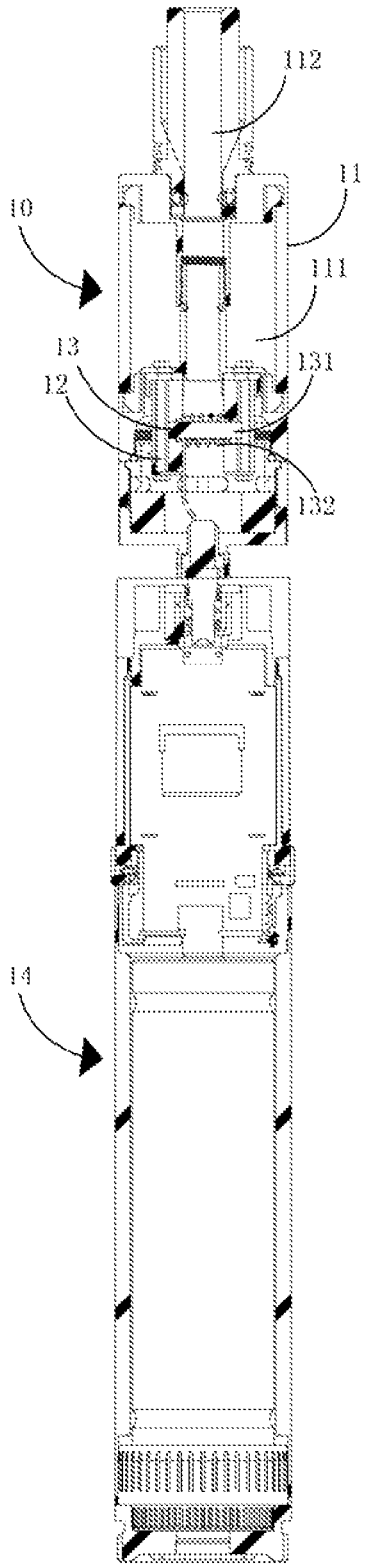
FIG. 1 is a cross-sectional view of an electronic cigarette according to a first embodiment, including a heating assembly.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Several definitions that apply throughout this disclosure will now be presented.

The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

Figure 2:
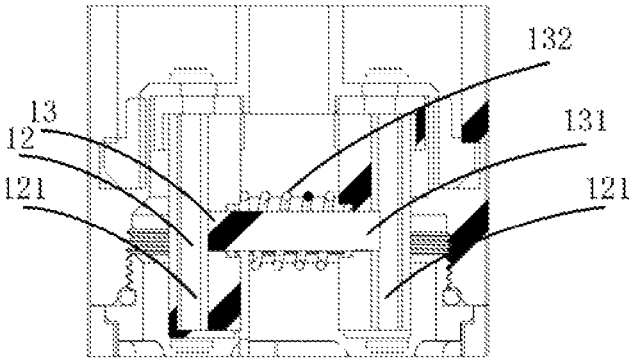
FIG. 2 is a cross-sectional view of the heating assembly of FIG. 1.

Referring to FIGS. 1-2, an electronic cigarette includes a main body 11, a liquid conducting groove 12, a heating assembly 13, and a power supply 14. The power supply 14 includes a rechargeable battery and a high frequency DC/AC inverter. The DC/AC inverter is configured (i.e., structured and arranged) for converting direct current to high frequency alternating current, and feeding the alternating current to the heating assembly 13. The main body defines a liquid chamber 111 and an air passage 112. The liquid chamber 111 is configured for storing tobacco liquid. The heating assembly 13 includes a liquid conducting and heating body 131 and an inductive coil 132.

The electronic cigarette includes two parts: a top part as the atomizer 10 and a bottom part (i.e., the power supply 14). The atomizer 10 and the power supply 14 are coupled with each other, and are electrically connected via electrodes. The liquid chamber 111 is defined in a housing of the atomizer 10. The heating assembly 13 is detachably arranged in the housing. It is to be noted that, in other embodiments, the atomizer 10 and the power supply 14 may be integrally formed.

The heating assembly 13 is arranged on the air passage 112. The liquid conducting and heating body 131 is in communication with the liquid chamber 111 via the liquid conducting groove 12. The liquid conducting and heating body 131 generates aerosol from the tobacco liquid, and then the aerosol is outputted via the air passage 112.

In detail, the liquid conducting groove 12 and the air passage 112 are oriented along an axial direction of the main body 11, and the liquid conducting and heating body 131 is oriented substantially perpendicular to the liquid conducting groove 12 and the air passage 112. Ends of the liquid conducting and heating body 131 are plugged into the liquid conducting groove 12, and are in contact with the tobacco liquid in the liquid conducting groove 12.

In the present embodiment, quite usefully, the liquid conducting groove 12 includes two substantially parallel liquid conducting sub-grooves 121. The liquid conducting and heating body 131 is substantially arranged between the two liquid conducting sub-grooves 121. Two opposite ends of the liquid conducting and heating body 131 are inserted into the two liquid conducting sub-grooves 121, respectively.

Figure 3:
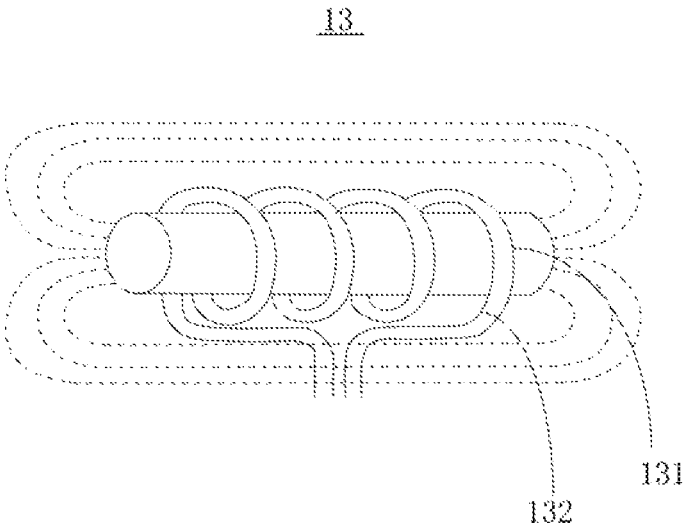
FIG. 3 is a perspective view of a heating assembly.

Referring to FIG. 3 together, the heating assembly 13 includes the liquid conducting and heating body 131 and the inductive coil 132. The inductive coil 132 is configured for generating high frequency magnetic field so that the liquid conducting and heating body 131 generates eddy current and heat. The liquid conducting and heating body 131 is configured for absorbing tobacco liquid and heating the tobacco liquid to form aerosol.

In the present embodiment, the liquid conducting and heating body 131 may be cylindrical or tubular. That is, the liquid conducting and heating body 131 may be a solid cylinder or a hollow cylinder.

In detail, the liquid conducting and heating body 131 includes a porous ceramic main body (not shown) and metallic powder (not shown) evenly distributed in the ceramic main body, and the ceramic main body and the metallic powder is integrally formed. Due to a micro-porous structure of the liquid conducting and heating body 131, the tobacco liquid permeates from ends of the liquid conducting and heating body 131 to a middle portion via a capillary action. A permeating speed of the tobacco liquid can be controlled by adjusting the porosity of the liquid conducting and heating body 131 during process of manufacturing the liquid conducting and heating body 131. Quite usefully, the ceramic body may be made of at least one of aluminum oxide, zirconium oxide, kaolin, diatomite, montmorillonite; the metallic power is iron cobalt powder.

The liquid conducting and heating body 131 is made using a method described below. First, a mixture is made by uniformly mixing a metallic powder (e.g., iron cobalt powder), foaming agent (e.g., polyurethane foaming agent), and at least one of aluminum oxide, zirconium oxide, kaolin, diatomite, and montmorillonite. Then, the mixture is molded to a predetermined shape (e.g., a cylindrical structure) using a mold. Finally, the molded mixture is under heat treatment to remove the foaming agent, thus obtaining the liquid conducting and heating body. The process of heat treatment includes the following steps: naturally withering the molded mixture; sintering the molded mixture in a high temperature furnace in a predetermined temperature. Quite usefully, the predetermined temperature is 1200-1400 Celsius Degrees.

In the present embodiment, the conductive coil 132 is wound around an outer peripheral surface of the liquid conducting and heating body 131. The conductive coil 132 is adjacent to the liquid conducting body 11, but not in contact with the liquid conducting and heating body 11. The inductive coil 132 is insulated from the liquid conducting and heating body 131. To achieve insulation, the inductive coil 132 may be an enamelled copper wire, and the liquid conducting and heating body 131 may include an insulated layer formed on an outer peripheral surface.

When a high frequency alternating current flows along the inductive coil 132, a high frequency magnetic field (see dotted lines as shown in FIG. 3) is generated. Then a large quantity of eddy current is generated in the metallic powder of the liquid conducting and heating body 131, so that the liquid conducting and heating body 131 heats up itself quickly. At the same time, the liquid conducting and heating body 131 absorbs tobacco liquid, and the tobacco liquid is heated by the liquid conducting and heating body 131 to form aerosol.

Since the liquid conducting and heating body 131 heats as a whole, the liquid conducting and heating body 131 has a large heating surface, and less loss of heat. Thus, a thermal efficiency of the liquid conducting and heating body 131 is high. Furthermore, because the metallic powder is evenly arranged in the liquid conducting and heating body 131, the liquid conducting and heating body 131 heats uniformly.

Figure 4:
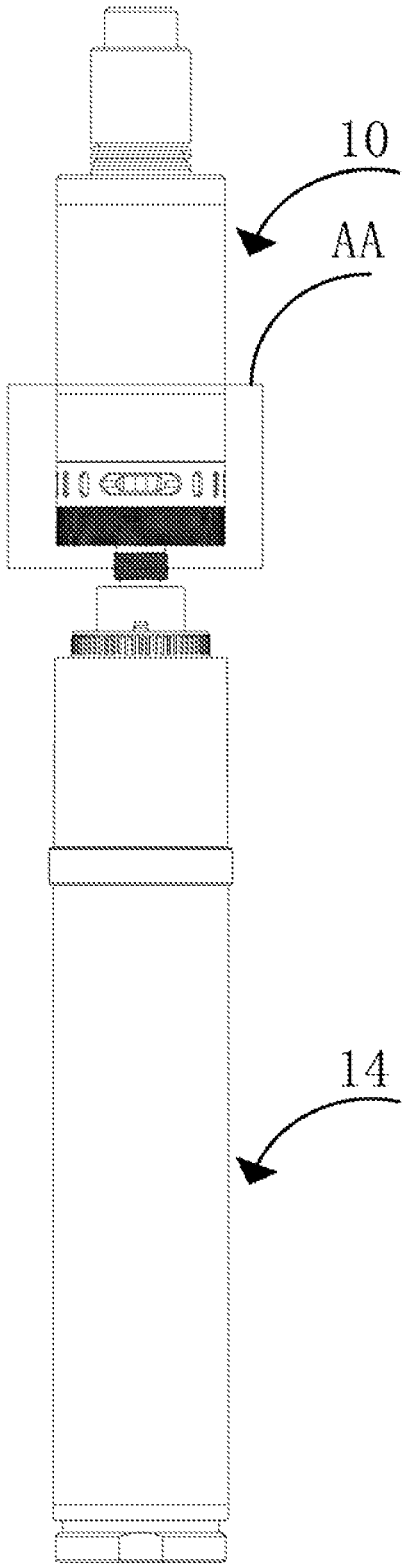
FIG. 4 is a perspective view of an electronic cigarette of FIG. 1.
Figure 5:
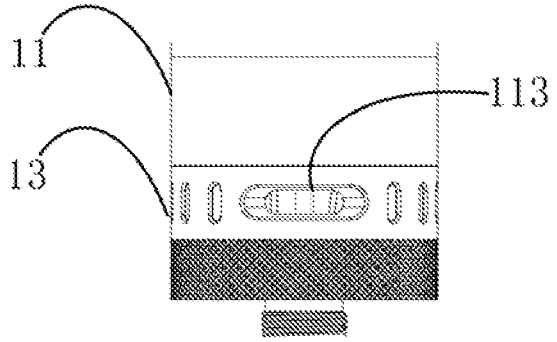
FIG. 5 is an enlarged view of area AA of FIG. 4.

Referring to FIGS. 4-5 together, the electronic cigarette further includes an airflow adjusting ring 13 in the main body 11. The airflow adjusting ring 13 is configured for adjusting an output of the aerosol. The main body 11 defines an air inlet 113. The airflow adjusting ring 13 adjusts the output of the aerosol by controlling an opening dimension of the air inlet 113, thus satisfying demand of different users.

Figure 6:
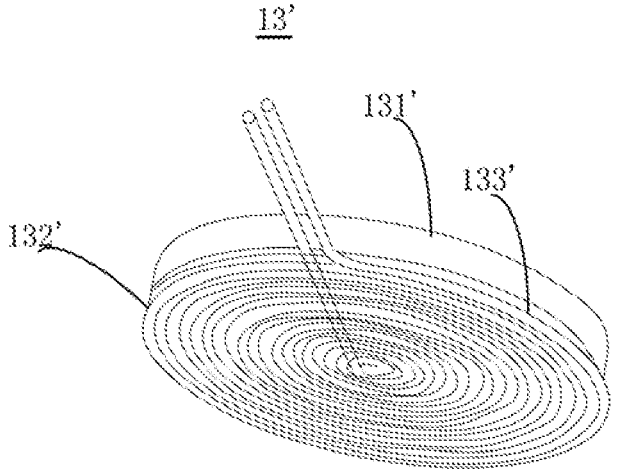
FIG. 6 is a cross-sectional view of a heating assembly according to a second embodiment.

Referring to FIG. 6, a heating assembly 13' according to a second embodiment is shown. The heating assembly 13' includes a liquid conducting and heating body 131' and an inductive coil 132'.

The liquid conducting and heating body 131 is disk-shaped. The inductive coil 132' is a disk-shaped coil, which is substantially parallel to the liquid conducting and heating body 131. One end of the inductive coil 132' is led out from a center of the inductive coil 132', the other end of the inductive coil 132' is led out from a periphery of the inductive coil 132'. Two ends of the inductive coil 132' are connected to an alternating current supply. Quite usefully, the liquid conducting and heating body 131' and the inductive coil 132' have an identical shape.

In the present embodiment, the heating assembly 13' further includes an insulator 133' sandwiched between the liquid conducting and heating body 131' and the inductive coil 132'.

Working principle and manufacturing method of the heating assembly 13' are similar to those of the heating assembly 13, and will not be described for brevity.

The liquid conducting and heating body 131' and the inductive coil 132' are both disc-shaped. Accordingly, a magnetic line force generated by the inductive coil 132' is more concentrated. Therefore, the efficiency of the heating assembly 13' is higher than that of the first embodiment.

It is understood that the above-described embodiments are intended to illustrate rather than limit the disclosure. Variations may be made to the embodiments and methods without departing from the spirit of the disclosure. Accordingly, it is appropriate that the appended claims be construed broadly and in a manner consistent with the scope of the disclosure.

What is claimed is:

1. An electronic cigarette, comprising:

a main body;

a heating assembly arranged in the main body, comprising:

a liquid conducting and heating body comprising a micro-porous ceramic main body and a metallic powder evenly distributed in the ceramic main body; and an inductive coil corresponding to the liquid conducting and heating body;

wherein the inductive coil is configured for generating high frequency magnetic field in response to an alternating current, so that eddy current and heat are generated in the metallic powder of the liquid conducting and heating body; the liquid conducting and heating body is configured for absorbing tobacco liquid in the ceramic main body and heating the tobacco liquid via the metallic powder to form aerosol;

a liquid conducting groove in communication with a liquid chamber, wherein the main body defines the liquid chamber and an air passage, the liquid chamber is configured for storing tobacco liquid, the heating assembly is arranged in the air passage, the liquid conducting and heating body is in communication with the liquid chamber via the liquid conducting groove, and the aerosol is expelled via the air passage; and a power supply configured for supplying the heating assembly with alternating current;

wherein the air passage is oriented along an axial direction of the main body, the liquid conducting and heating body is oriented perpendicular to the air passage, an end of the liquid conducting and heating body is plugged into the liquid conducting groove, and the end of the liquid conducting and heating body contacts with the tobacco liquid in the liquid conducting groove.

2. The electronic cigarette according to claim 1, wherein the ceramic main body is made of at least one material selected from a group consisting of aluminum oxide, zirconium oxide, kaolin, diatomite, montmorillonite, and the metallic powder comprises iron cobalt powder.

3. The electronic cigarette according to claim 1, wherein the liquid conducting and heating body is cylindrical or tubular, and the inductive coil is wound around an outer peripheral surface of the liquid conducting and heating body.

4. The electronic cigarette according to claim 1, wherein the liquid conducting and heating body is disk-shaped, the inductive coil is a disk-shaped coil, and the inductive coil is parallel to the liquid conducting and heating body; a first end of the inductive coil is led out from a center of the inductive coil, and an opposite second end of the inductive coil is led out from a periphery of the inductive coil.

5. The electronic cigarette according to claim 4, wherein the heating assembly further comprises an insulator sandwiched between the liquid conducting and heating body and the inductive coil.

6. The electronic cigarette according to claim 1, wherein the main body defines an air inlet; the electronic cigarette further comprises an airflow adjusting ring in the main body, and the airflow adjusting ring is configured for adjusting an output of the aerosol by controlling an opening dimension of the air inlet.

* * * * *